US008482427B2

(12) United States Patent
Curran et al.

(10) Patent No.: US 8,482,427 B2
(45) **Date of Patent: *Jul. 9, 2013**

(54) METHOD AND APPARATUS FOR PROVIDING A NOTIFICATION APPLIANCE WITH A LIGHT EMITTING DIODE

(75) Inventors: John W. Curran, Lebanon, NJ (US); Shawn P. Keeney, Eatontown, NJ (US)

(73) Assignee: Wheelock, Inc., Long Branch, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/245,401

(22) Filed: Sep. 26, 2011

(65) Prior Publication Data

US 2012/0013480 A1 Jan. 19, 2012

Related U.S. Application Data

(63) Continuation of application No. 12/559,378, filed on Sep. 14, 2009, now Pat. No. 8,026,828, which is a continuation of application No. 11/096,773, filed on Apr. 1, 2005, now Pat. No. 7,663,500.

(60) Provisional application No. 60/654,757, filed on Feb. 18, 2005, provisional application No. 60/558,444, filed on Apr. 1, 2004.

(51) Int. Cl.
*G08B 5/22* (2006.01)

(52) U.S. Cl.
USPC ..... 340/815.45

(58) Field of Classification Search
USPC ..... 340/815.45, 331, 693.1, 384.1, 815.65, 340/555; 362/231, 347
See application file for complete search history.

(56) References Cited

U.S. PATENT DOCUMENTS

| | | | | |
|---|---|---|---|---|
| 5,559,492 | A | 9/1996 | Stewart et al. | |
| 6,426,697 | B1 | 7/2002 | Capowski et al. | |
| RE38,183 | E * | 7/2003 | Kosich et al. | 340/331 |
| 6,603,243 | B2 | 8/2003 | Parkyn et al. | |
| 6,661,521 | B1 | 12/2003 | Stern | |
| 6,833,783 | B2 | 12/2004 | Ha et al. | |
| 6,871,982 | B2 | 3/2005 | Holman et al. | |
| 7,300,185 | B1 | 11/2007 | Ruffin et al. | |
| 7,663,500 | B2 | 2/2010 | Curran et al. | |
| 8,026,828 | B2 | 9/2011 | Curran et al. | |
| 8,026,829 | B2 | 9/2011 | Curran et al. | |
| 2001/0033503 | A1 * | 10/2001 | Hamp et al. | 363/73 |
| 2003/0107495 | A1 | 6/2003 | Swieboda et al. | |
| 2004/0052090 | A1 | 3/2004 | Pederson | |
| 2004/0233664 | A1 * | 11/2004 | Beeson et al. | 362/231 |
| 2004/0246606 | A1 | 12/2004 | Benitez et al. | |
| 2005/0110808 | A1 | 5/2005 | Goldschmidt et al. | |
| 2005/0122727 | A1 | 6/2005 | Machi et al. | |
| 2005/0225988 | A1 | 10/2005 | Chaves et al. | |
| 2006/0039140 | A1 | 2/2006 | Magarill | |
| 2006/0076568 | A1 | 4/2006 | Keller et al. | |
| 2006/0109475 | A1 | 5/2006 | Misener et al. | |
| 2010/0052935 | A1 | 3/2010 | Curran et al. | |
| 2010/0052936 | A1 | 3/2010 | Curran | |

OTHER PUBLICATIONS

PCT Search Report and Written Opinion for PCT/US05/11174, Jul. 7, 2008, consists of 11 unnumbered pages.

* cited by examiner

*Primary Examiner* — Phung Nguyen

(57) ABSTRACT

A method and apparatus for providing a strobe alarm unit employing at least one light emitting diode.

18 Claims, 6 Drawing Sheets

SYSTEM BLOCK DIAGRAM

METHOD AND APPARATUS FOR PROVIDING A NOTIFICATION APPLIANCE WITH A LIGHT EMITTING DIODE

This application is a continuation of U.S. patent application Ser. No. 12/559,378 filed Sep. 14, 2009, which is a continuation of U.S. patent application Ser. No. 11/096,773 filed Apr. 1, 2005, now, U.S. Pat. No. 7,663,500, which claims the benefit of U.S. Provisional Application No. 60/558,444 filed on Apr. 1, 2004 and No. 60/654,757 filed on Feb. 18, 2005, where each of the above cited applications is herein incorporated by reference.

The present invention relates to a novel method and apparatus for providing a notification or alert appliance. Specifically, the present invention provides an efficient and robust notification appliance, e.g., a strobe alarm unit having a light emitting diode (LED).

BACKGROUND OF THE INVENTION

Field of the Invention

Strobe lights have been widely employed in warning systems such as fire warning systems, security systems and the like. In fact, various governmental regulations and/or standards, e.g., from the American Disability Act (ADA) and the Underwriters Laboratories (UL), have been established to define various requirements, e.g., strobe frequency and light output.

One important requirement is the light output of a strobe alarm unit for a particular application. For example, UL has adopted standards that require certain levels of light output from strobe alarm units for fire safety warning systems. Depending on a particular application and/or the location where the strobe alarm units are mounted, light output may range from 15 candela to 110 candela. To achieve these light output requirements, manufacturers have traditionally employed flashtubes to provide the necessary levels of light output.

However, flashtubes require a substantial amount of power to generate the necessary levels of light output. This requirement affects the size, packaging and cost associated with the use of flashtubes in strobe alarm units. Additionally, flashtubes have a failure rate that may not be appropriate in some applications.

Therefore, a need exists in the art for a strobe alarm unit having a light element that is capable of providing the necessary intensity levels without the use of flashtubes.

SUMMARY OF THE INVENTION

In one embodiment, the present invention provides a strobe alarm unit or notification appliance employing at least one light emitting diode (LED). In one embodiment, a plurality of LEDs can be employed. In another embodiment, at least one multi-color LED is employed.

Since LEDs can be operated in a lower voltage and/or with a lower profile, it provides advantages over notification appliances that use a flashtube as the light generating element. One advantage of the lower voltage is added safety in the operation, trouble shooting and handling of the notification appliance. Another advantage is that LED based notification appliance has a low profile that will allow design flexibility. Furthermore, LEDs have an extended life when compared to flashtubes, thereby increasing reliability of the overall notification appliance.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
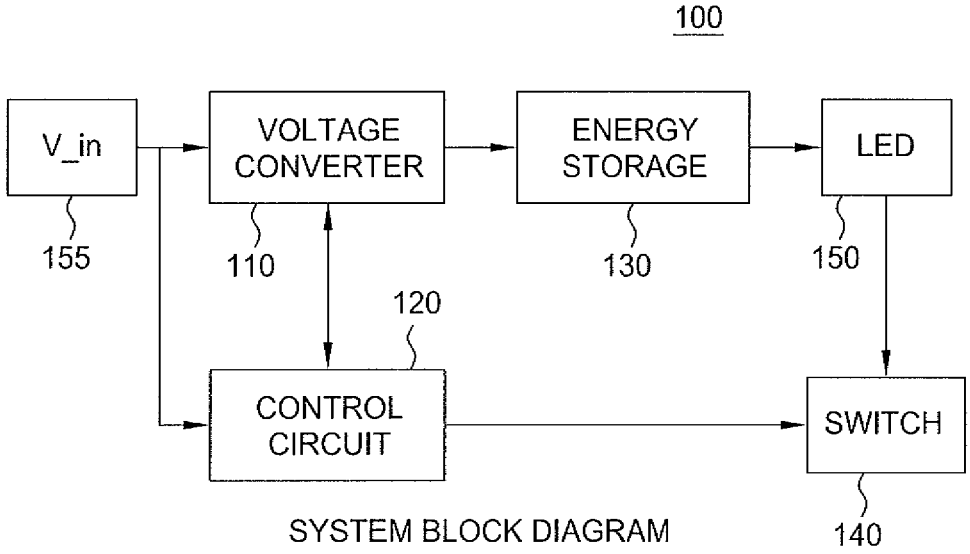
FIG. 1 illustrates a block diagram of an LED strobe in accordance with the present invention.

FIG. 1 illustrates a block diagram of an LED strobe 100 in accordance with one embodiment of the present invention. In this embodiment, the LED strobe 100 comprises a voltage converter 110, a control circuit 120, an energy storage device 130, a switch 140 and an LED 150. Power to the LED strobe 100 is received via voltage input 155.

FIG. 1 outlines the basic circuit for the LED strobe in one embodiment. In operation, the circuit employs a voltage converter 110 to step an input voltage, e.g., 16 to 45 VDC down to around 10 to 12 VDC. In one embodiment, the voltage converter may employ an inrush current limiter to address inrush current condition. An energy storage device 130, such as one or more capacitors are employed to store charge to be pulsed through the LED 150.

In one embodiment, the switch 140 is implemented using MOSFET and the control circuit 120 is implemented using a microcontroller. Unlike conventional flashtube based alarm units, where the flashtube will automatically cease to emit light after the stored energy falls below a level, i.e., discharged through the flashtube, the present invention requires a switch to turn on and off the LED. This is due to the fact that the LED operates under a much lower voltage requirement than the flashtube. For example, in one embodiment, to drive an LED, approximately one ampere of current is needed for a duration of approximately 50 msec. or less. As such, there is still a fair amount of energy stored in the energy storage device after each flash period. Thus, the switch is used to turn on the LED at the beginning of the flash period and to turn the LED off and the end of the flash period.

Figure 2:
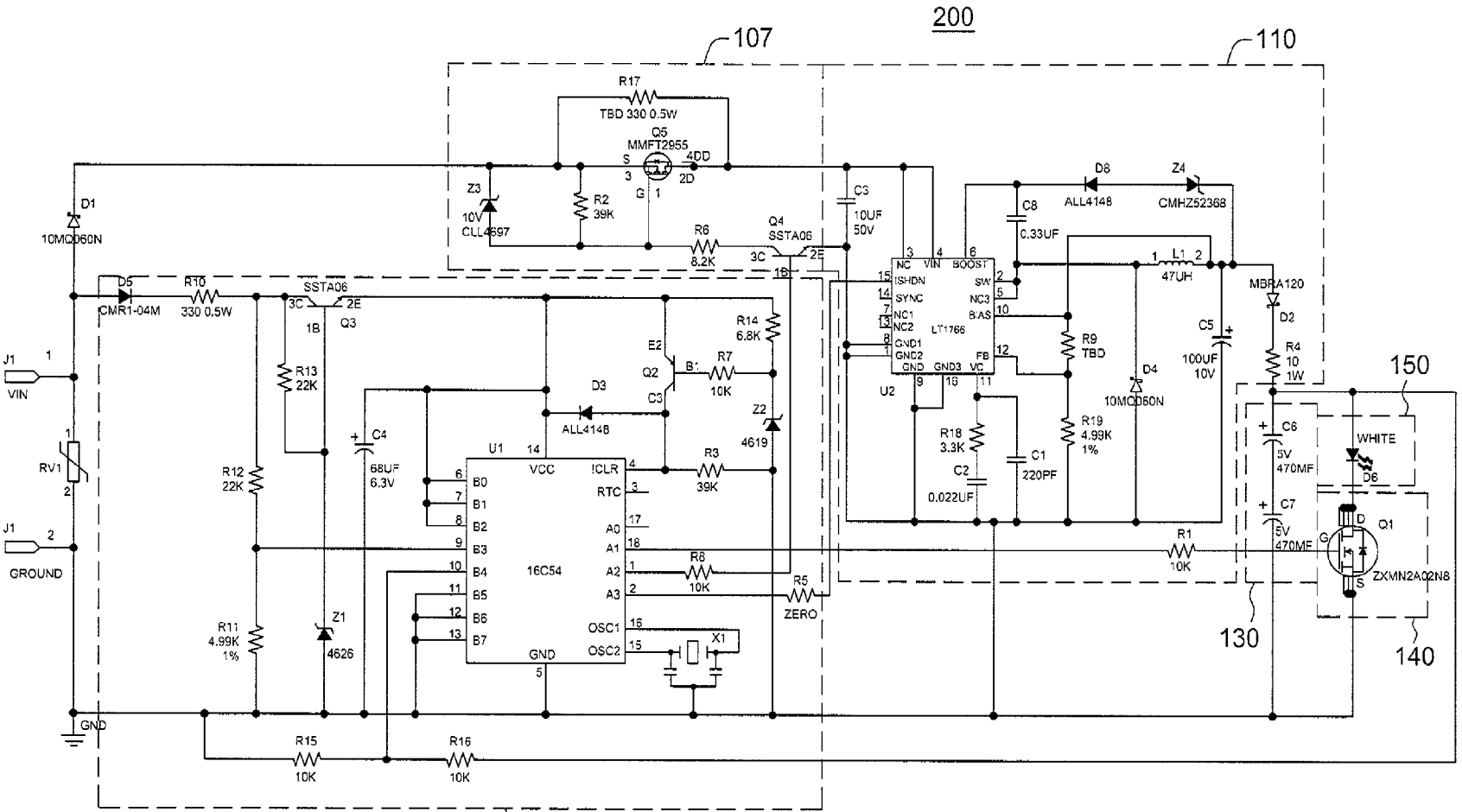
FIG. 2 illustrates an exemplary schematic diagram of an LED strobe in accordance with the present invention.

A circuit that embodies the various modules of FIG. 1 is shown in the schematic diagram of FIG. 2. FIG. 2 illustrates an exemplary schematic diagram of an LED strobe 100 in accordance with the present invention. It should be noted that FIG. 2 only provides an illustrative implementation as to how an LED is deployed in a strobe alarm. It should be noted that FIG. 2 can be adapted to provide an LED in a strobe alarm unit with audible capability.

FIG. 2 is also illustrated with dashed lines to indicate various corresponding modules/circuits as depicted in FIG. 1. Although the components are grouped using the dashed lines, it is understood that individual components may serve functions within one or more modules/circuits. Additionally, a current limiter 107, e.g., an inrush current limiter, is illustrated next to the voltage converter 110.

In one embodiment, the present invention uses a 555 timer to control the switch and a LM2593HV buck converter regulator from National Semiconductor. In one embodiment, the buck converter is configured to produce an output of 11.2 volts. For energy storage, a pair of Cooper 470 mF, 5V supercapacitors is deployed in series. A 15 ohm, ½ watt resistor is placed in series with the capacitors to gradually charge the capacitors and to make the input current continuous instead of a pulse. The switch is an IRFU3711. For example, the LED device is a 5 W white Luxeon star emitter produced by Lumileds of San Jose, Calif.

Table 1 below illustrates some exemplary results by varying the on time for the LED.

TABLE 1

| $V_{in}$ | $I_{in}$ (mA) | $V_{out}$ avg | $I_{out}$ RMS (amperes) | t_on (ms) | E out (joules) | Efficiency |
|---|---|---|---|---|---|---|
| 16 | 109 | 9.4 | 1.67 | 65 | 1.02 | 58.5% |
| 24 | 76 | 9.4 | 1.67 | 65 | 1.02 | 55.9% |
| 33 | 58 | 9.4 | 1.67 | 65 | 1.02 | 53.3% |
| 16 | 136 | 8.8 | 1.47 | 100 | 1.29 | 59.4% |
| 16 | 95 | 9.6 | 2.00 | 50 | 0.96 | 63.2% |
| 24 | 67 | 9.6 | 2.00 | 50 | 0.96 | 59.7% |
| 33 | 51 | 9.6 | 2.00 | 50 | 0.96 | 57.0% |

Table 2 illustrates some exemplary results pertaining to temperature measurement in relation to applied current (in amperes). For example, the following temperature data was obtained by pulsing a 5 W LED at various current settings with a 100 millisecond on time and 1 second flash period. The temperature was measured on the slug.

TABLE 2

| Current | T_celsius |
|---|---|
| 1.00 | 81 |
| 1.25 | 96 |
| 1.50 | 111 |
| 1.75 | 126 |
| 2.00 | 140 |
| 2.50 | 170 |

Table 3 illustrates some exemplary results pertaining to temperature measurement in relation to applied current (in amperes). Namely, the following temperature data was obtained by pulsing an LED at various current settings at 50 milliseconds.

TABLE 3

| Current | T_celsius |
|---|---|
| 1.00 | 50 |
| 1.25 | 56 |
| 1.50 | 63 |
| 1.75 | 70 |
| 2.00 | 77 |
| 2.25 | 84 |

TABLE 3-continued

| Current | T_celsius |
|---|---|
| 2.50 | 92 |
| 3.00 | 107 |
| 3.50 | 122 |

In one embodiment, the maximum internal junction temperature for the device is 135 degrees Celsius.

Table 4 illustrates exemplary candela polar plot data that was taken by driving a 5 W Luxeon with a 1.0 ampere, 100 millisecond pulse. It should be noted that the data illustrated is the raw light element light output generated without lens correction. With proper lens correction, UL requirements can be met.

TABLE 4

| Angle | 100% UL | | 1 15 Hor | % margin |
|---|---|---|---|---|
| −90 | 25% | 3.75 | 1.43 x | −61.9% |
| −85 | 25% | 3.75 | 2.76 x | −26.4% |
| −80 | 30% | 4.50 | 4.00 x | −11.1% |
| −75 | 30% | 4.50 | 5.20 | 15.6% |
| −70 | 35% | 5.25 | 6.69 | 27.4% |
| −65 | 35% | 5.25 | 7.97 | 51.8% |
| −60 | 40% | 6.00 | 9.27 | 54.5% |
| −55 | 45% | 6.75 | 10.44 | 54.7% |
| −50 | 55% | 8.25 | 11.64 | 41.1% |
| −45 | 75% | 11.25 | 12.59 | 11.9% |
| −40 | 75% | 11.25 | 13.41 | 19.2% |
| −35 | 75% | 11.25 | 13.82 | 22.8% |
| −30 | 75% | 11.25 | 14.72 | 30.8% |
| −25 | 90% | 13.50 | 15.05 | 11.5% |
| −20 | 90% | 13.50 | 15.53 | 15.0% |
| −15 | 90% | 13.50 | 15.65 | 15.9% |
| −10 | 90% | 13.50 | 16.03 | 18.7% |
| −5 | 90% | 13.50 | 16.50 | 22.2% |
| 0 | 100% | 15.00 | 16.55 | 10.3% |

In one embodiment, it has been observed that the light output is proportional to the on time and the current through the LED. If the current is doubled, then the light output is doubled, or if the on time is halved then the light output is halved.

In one embodiment, a red LED with a collimating lens was measured that produced 36 candela at 0 degrees with a 10 millisecond, 2.0 A pulse.

Using an LED in a strobe alarm unit poses several challenging issues. One issue is the ability to drive high intensity LEDs with high current.

To illustrate, one of the factors, which limit the amount of current, which can be pushed through a high intensity LED, is the junction temperature. This junction is the p-n junction of the semiconductor device at which point the light is created and emitted. Since LEDs may not be 100% efficient, a certain percentage of the input power (I×V) is wasted as heat within the device. The more current (I) that is pumped through the device, the more heat is created at this junction. Heat build up at this p-n junction can be one of the limiting factors in producing higher intensity LED sources.

In order to reduce the heat build up at the junction, one can employ heat sink type devices to remove at least a portion of this heat. This approach may be limited by the ability to locate the device junction within reasonable thermal proximity to the heat sink. Manufacturers of high intensity LEDs may provide numerous methods and types of heat sinks to achieve the result of reducing the junction temperature.

Alternatively, a different approach recognizes that once the LED is turned off, the junction temperature drops. The longer the device is turned off, the closer the junction temperature returns to room temperature. Using this factor, in one embodiment, the present method may improve the performance of the LED by employing a duty cycle approach to power the LED. Data taken on the junction temperature of the LED indicates that by reducing the duty cycle of the LED, the junction temperature is lowered. Basically, the junction gets a chance to "cool off" during the period the LED is turned off. By lowering the rise in junction temperature, the amount of current which can be pumped through the LED increases. This, in turn, increases the amount of light produced by the LED.

However, by reducing the duty cycle, the amount of light produced is decreased proportionally. A 50% duty cycle produces 50% of the light of continuous operation. If, however, the amount of current, which can be pumped through the LED, increases at a rate greater than linear, a net gain is observed. Thus by using a duty cycle approach the overall amount of light, which can be produced using the LED increases.

It should be noted that the present invention contemplates the use of some form of optics, e.g., reflector and/or lens to meet the various light distribution patterns or intensities as required by various UL standards. The lens and/or reflector may assist in focusing the light, e.g., into a narrower or wider viewing angles depending on the application.

Additionally, the present invention is not limited to a particular type or color of LEDs. For example, the color of the LED may include amber, orange, green, red, blue and so on. In fact, the present invention may employ color lens as well. Furthermore, in one embodiment, the LED may be a tri-color LED as well.

In one embodiment, the LED of the present invention is a broad lambertian distribution LED. A broad distribution LED is an LED that has a distribution angle in the range of plus or minus 75 degrees or greater. In contrast, a narrow distribution LED typically has a distribution angle in the range of plus or minus 10 degrees.

It should also be noted that the LED employed in the present invention is a high current density LED versus a low current density LED (e.g., an indication LED). Namely, in one embodiment, a single LED of the present invention may provide sufficient light output e.g., at least 15 candela or greater of light output, to serve the function as a notification light source instead of an indicator LED that is typically used to indicate on/off status of a device.

Figure 3:
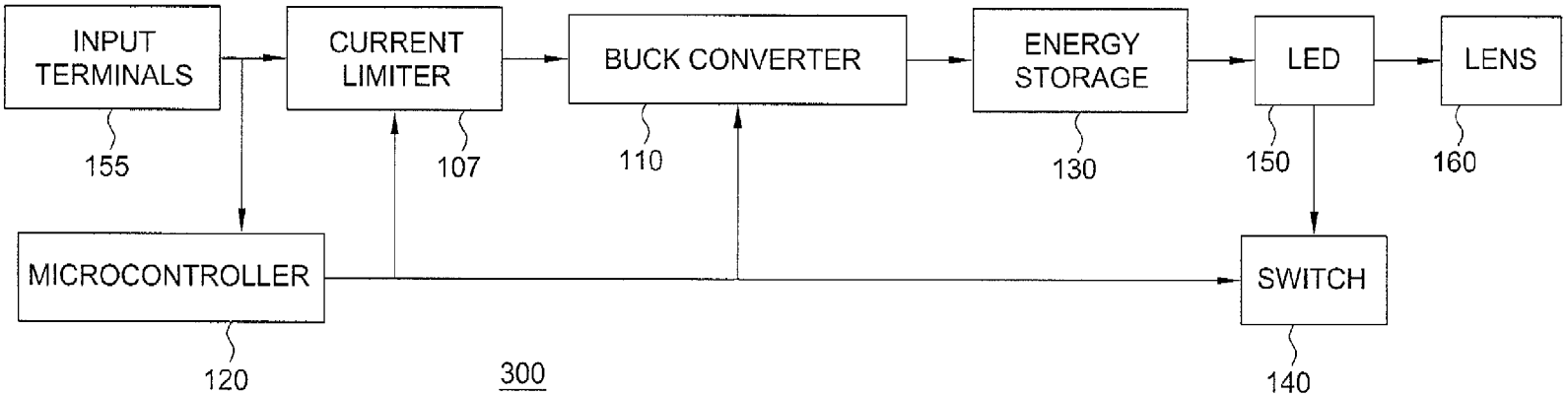
FIG. 3 illustrates an alternate block diagram of a configuration of an LED strobe in accordance with the present invention.

FIG. 3 illustrates an alternate block diagram of an LED strobe 300 in accordance with the present invention. This block diagram is similar to FIG. 1 and various modules/circuits share the same reference numerals and similar functions. In one embodiment, the LED strobe 300 comprises input terminals 155, a current limiter 107, a buck converter 110, a control circuit, e.g., a microcontroller 120, an energy storage device 130, a switch 140, an LED 150, and a lens 160. Power to the LED strobe 100 is received via voltage input terminals 155.

FIG. 3 outlines the basic circuit for the LED strobe 300 in one embodiment. In operation, the voltage converter 110, e.g., a buck converter converts the input voltage from 16 volts to 33 volts. The energy from the buck converter is stored in the energy storage 130, e.g., a pair of 470 mF capacitors connected in series. The energy is released from the capacitors when the LED 150 is turned on. This circuit will require a method of charging the storage capacitors while the system is in stand-by mode, so that when the unit is activated the LED will be at full brightness. One exemplary schematic diagram of the LED strobe 300 is shown in FIG. 2.

Figure 4:
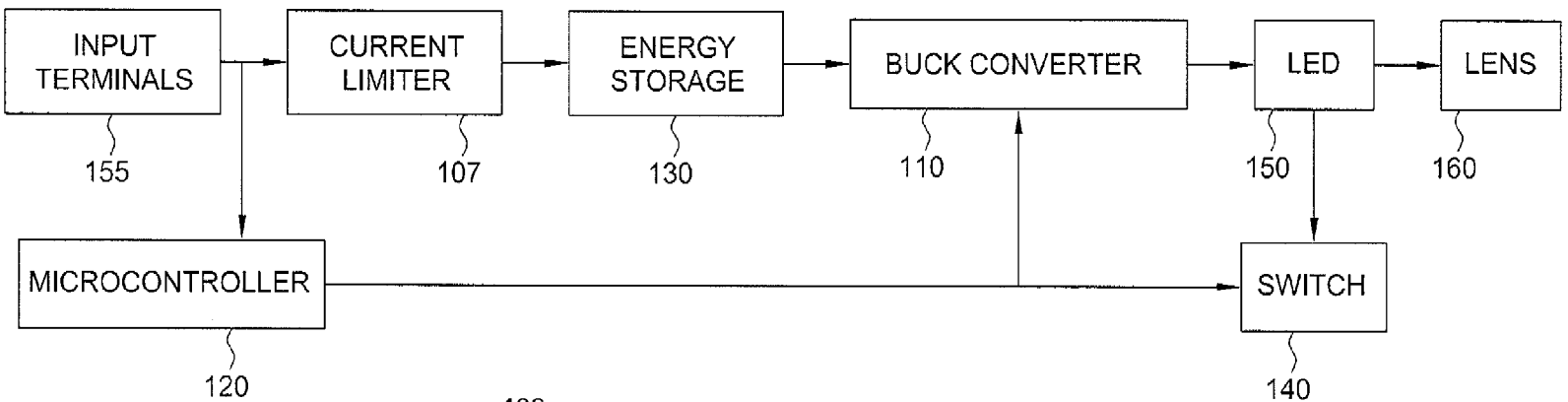
FIG. 4, illustrates an alternate block diagram of a configuration of an LED strobe in accordance with the present invention.
Figure 6:
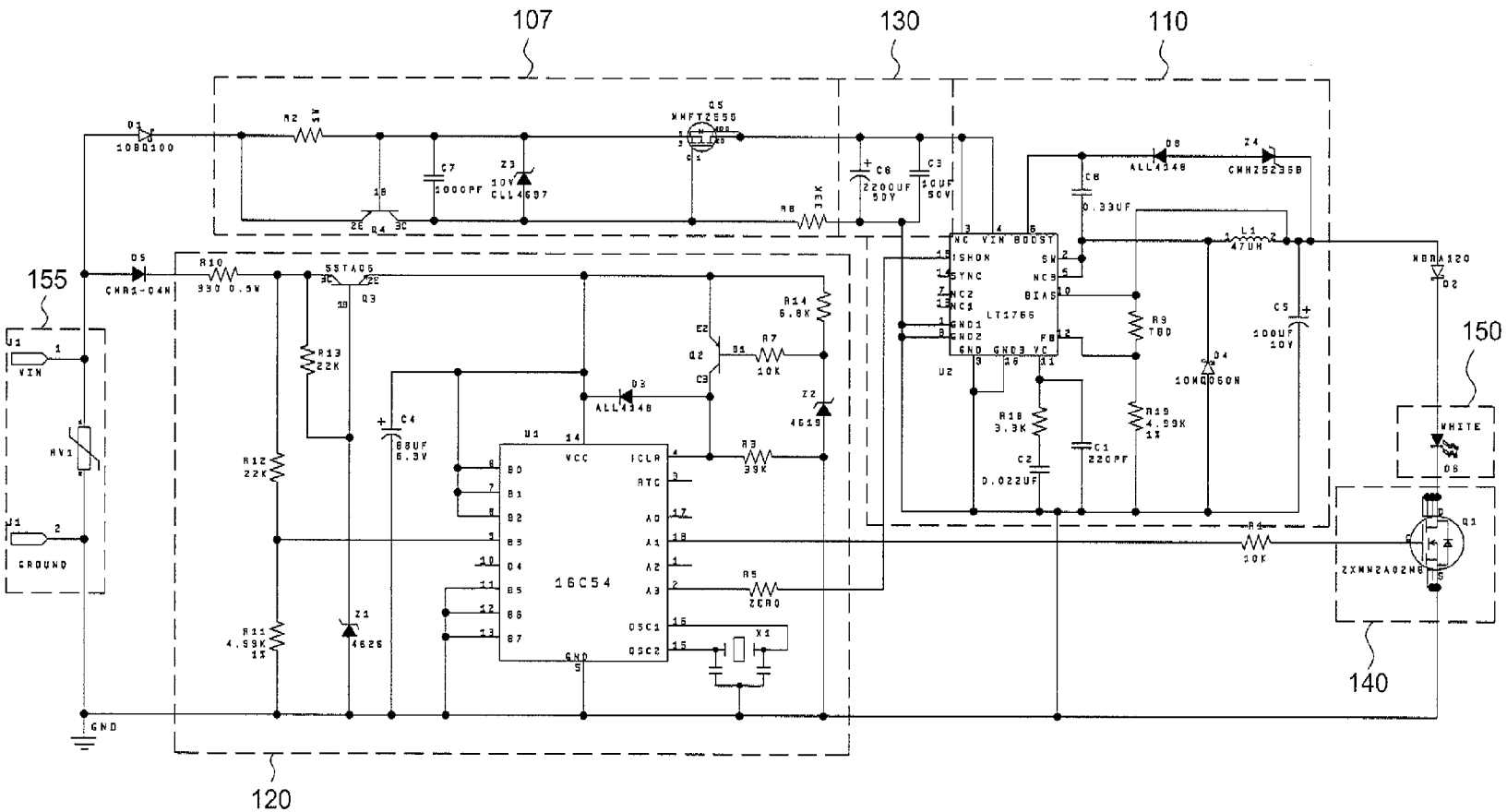
FIG. 6 illustrates an exemplary schematic diagram of an LED strobe in accordance with the present invention.

FIG. 4 illustrates an alternate configuration of the basic circuit for the LED strobe 400 in one embodiment. This block diagram is also similar to FIG. 1 and various modules/circuits share the same reference numerals and similar functions. In this alternate configuration, the energy storage capacitor 130 has been moved to a position in the circuit which is before the buck converter 110. Energy is stored in this capacitor and stored until the LED is pulsed, causing the buck converter 110 to draw energy from the storage capacitor. The circuit has been modified to include a foldback current limiter 107 utilizing a PNP transistor and a P-channel MOSFET. This circuit controls the rate of charge of the energy storage capacitor, preventing a high surge current. This alternate configuration makes the unit more compatible with existing fire systems. One exemplary schematic diagram of the LED strobe 400 is shown in FIG. 6.

Figure 5:
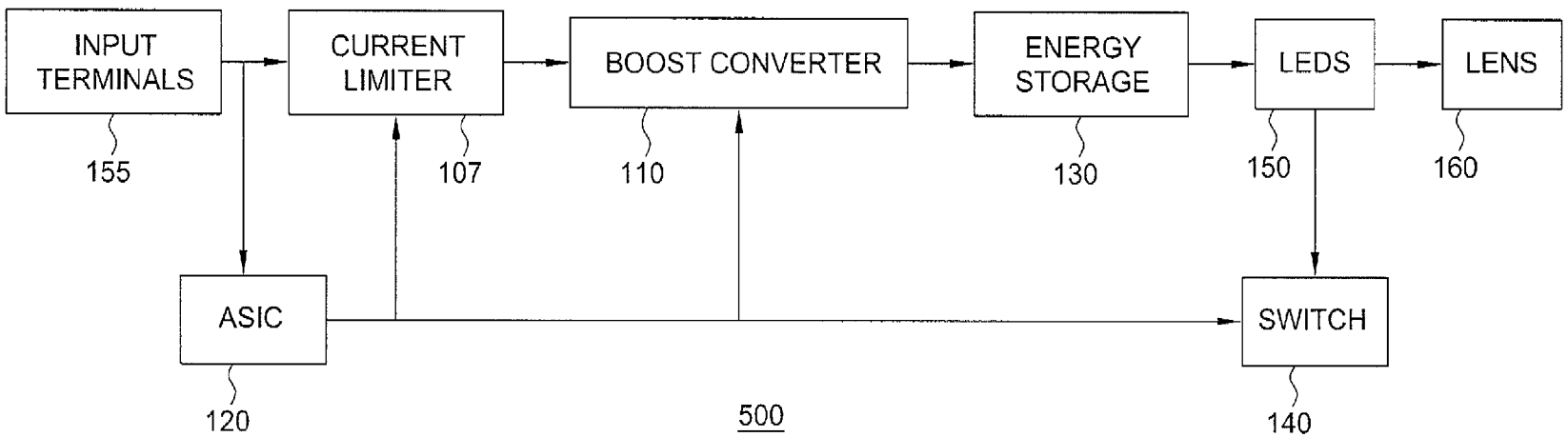
FIG. 5, illustrates an alternate block diagram of a configuration of an multi-LEDs strobe in accordance with the present invention.
Figure 7:
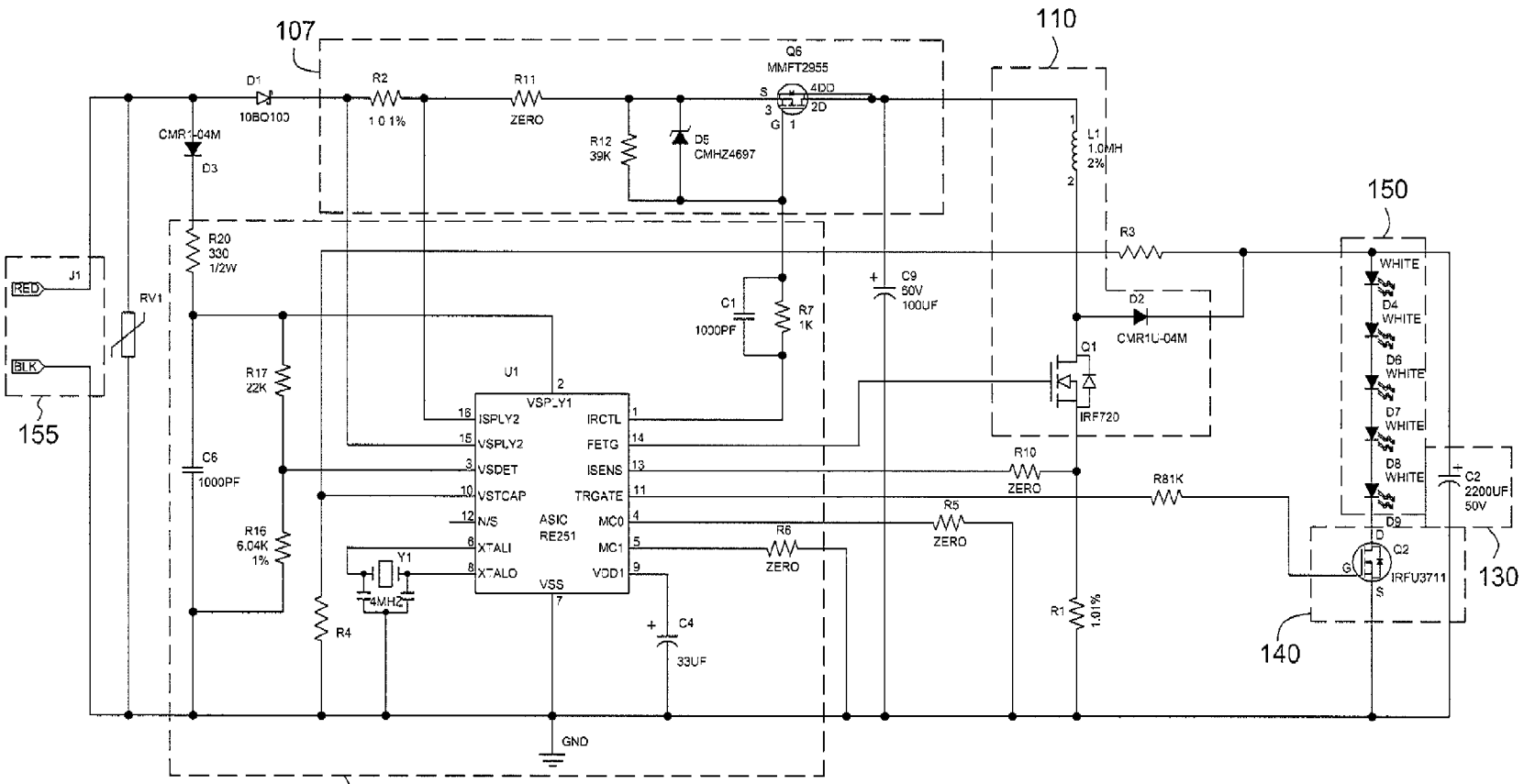
FIG. 7 illustrates an exemplary schematic diagram of an multi-LEDs strobe in accordance with the present invention.

FIG. 5 illustrates an alternate configuration of the basic circuit for the multi-LEDs strobe 500 in one embodiment. This block diagram is also similar to FIG. 1 and various modules/circuits share the same reference numerals and similar functions. In this alternate configuration, the strobe employs a plurality of LEDs, e.g., using 4 or more LEDs in series. The circuit uses a pulse-width modulated boost converter 110 to charge a storage capacitor. The energy from the capacitor is discharged into the LEDs. In this embodiment, the control circuit 120 comprises an application specific integrated circuit (ASIC). One exemplary schematic diagram of the multi-LEDs strobe 300 is shown in FIG. 7.

For many years the fire industry has used white light to visually indicate an alarm in buildings. These flashing strobe lights provide warnings to both people that have hearing impairments as well as to the general population in areas where the background ambient noise level is too loud to allow use of horns, bells and speakers. As this industry broadens its attention to include other emergency conditions such as security or weather related emergencies, the need to be able to distinguish the type of emergency becomes necessary. In the case of visual strobe signals, one can use various color lights to indicate the type of emergency (e.g. white for fire; blue for weather, etc.).

Presently manufacturers of strobe products use the standard clear xenon flashtube as the light generating source for the various emergency signals. By varying the color of the transparent lens used to cover the flashtube, the color of the strobe can be changed. Unfortunately, in order to indicate more than one type of emergency, multiple flashtube strobe products must be purchased and installed.

In contrast, a multicolor LED in place of a white LED can be deployed in the various embodiments as discussed above as the light source to produce an alert strobe signal. If, for example, a tricolor LED (red, blue and green) were to replace the white LED, then by varying the amount of current fed to each of the elements of the tricolor LED, the color of the strobe could be varied. Using similar circuitry to that described previously, 3 independent drive circuits could be enclosed in the same housing, each circuit driving one of the LED elements. Alternatively, one circuit could be used with a selection means to allow a given percentage of the energy stored in the circuit to be applied to each of the LED elements. The selection means could be any type of coded signal which could be interpreted by the drive circuitry of the LED device and which would select the percentage of energy applied to each of the LED elements. For example, coded signals in accordance with U.S. Pat. Nos. 5,608,375 and 5,982,275 can be used.

The present invention would also anticipate multicolor LEDs with various number of LED elements (2 or more colors). In addition, the present invention would also include strobe devices which comprise of multiple LEDs in the same strobe unit, each capable of producing only a single color, but in combination with the other LEDs in the assembly that would produce the desired colors.

Since LEDs can be operated in a lower voltage and/or with a lower profile, it provides advantages over notification appliances that use a flashtube as the light generating element. One advantage of the lower voltage is added safety in the operation, trouble shooting and handling of the notification appliance. Another advantage is that LED based notification appliance has a low profile that will allow design flexibility. Furthermore, LEDs have an extended life when compared to flashtubes, thereby increasing reliability of the overall notification appliance.

Another advantage is that LED based notification appliance has a low profile that will allow design flexibility. For example, LED based notification appliance can be deployed in a less obtrusive manner than traditional flashtube based notification appliance. This is due to the fact that the smaller size of the LED. Additionally, due to the lower operating voltage, the drive circuit for the LED can be deployed further away from the LED, e.g., using longer wires to extend the LED. In contrast, traditional flashtubes based notification appliance typically deploy the flashtube circuit close to the flashtube due to significantly higher operating voltage. As such, traditional flashtube based notification appliances tend to have a much higher profile due to size of the flashtube, the associated reflector and the driver circuit.

While foregoing is directed to the preferred embodiment of the present invention, other and further embodiments of the invention may be devised without departing from the basic scope.

What is claimed is:

1. A strobe notification appliance, comprising:

at least one broad distribution light emitting diode (LED), wherein the at least one broad distribution LED comprises at least one high current density LED;

an energy storage device for storing energy; and a control circuit for causing said stored energy to be applied to said at least one broad distribution LED in a reduced duty cycle while providing current at a rate greater than linear to increase an amount of light emitted by the at least one broad distribution LED and to reduce heat build up at a p-n junction of the at least one broad distribution LED, wherein said at least one broad distribution LED comprises at least one single color LED.

2. The strobe notification appliance of claim 1, wherein said at least one high current density LED is capable of producing at least 15 candela.

3. The strobe notification appliance of claim 1, wherein said at least one broad distribution LED comprises at least one LED device combined with a lens to produce at least 15 candela.

4. The strobe notification appliance of claim 1, wherein said at least one high current density LED is capable of producing a high intensity white light.

5. The strobe notification appliance of claim 1, wherein said at least one broad distribution LED comprises at least one LED device combined with a lens to produce a high intensity light.

6. The strobe notification appliance of claim 1, further comprising:

a lens to widen a viewing angle of the at least one broad distribution LED.

7. The strobe notification appliance of claim 1, further comprising:

a reflector to widen a light distribution pattern of the at least one broad distribution LED.

8. The strobe notification appliance of claim 1, further comprising:

a voltage converter coupled to the energy storage device.

9. The strobe notification appliance of claim 1, further comprising:

a current limiter coupled to the energy storage device.

10. The strobe notification appliance of claim 9 further comprising:

a buck converter coupled between the energy storage device and said at least one broad distribution LED.

11. The strobe notification appliance of claim 1, wherein said control circuit comprises a microcontroller.

12. The strobe notification appliance of claim 1, wherein said control circuit comprises an application specific integrated circuit (ASIC).

13. A strobe notification appliance, comprising:

at least one broad distribution light emitting diode (LED), wherein the at least one broad distribution LED comprises at least one high current density LED;

means for storing energy; and means for controlling said means for storing energy for applying stored energy to said at least one broad distribution LED in a reduced duty cycle while providing current at a rate greater than linear to increase an amount of light emitted by the at least one broad distribution LED and to reduce heat build up at a p-n junction of the at least one broad distribution LED, wherein said at least one broad distribution LED comprises at least one single color LED.

14. The strobe notification appliance of claim 13, further comprising:

means for converting voltage, coupled to said means for storing energy, for stepping an input voltage.

15. The strobe notification appliance of claim 14, wherein said means for converting voltage comprises a buck converter.

16. The strobe notification appliance of claim 14, wherein said means for converting voltage comprises at least one current limiting means.

17. The strobe notification appliance of claim 13, wherein said means for controlling comprises a microcontroller or an application specific integrated circuit (ASIC).

18. The strobe notification appliance of claim 13, further comprising:

means for switching the stored energy to said at least one broad distribution LED at a pulse duration determined by said means for controlling.

* * * * *